US011319783B1

(12) United States Patent
Keller

(10) Patent No.: US 11,319,783 B1
(45) Date of Patent: May 3, 2022

(54) METHOD FOR GUIDING THE DIRECTION OF EVERSION OF A FLEXIBLE LINER

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 0 days.

(21) Appl. No.: 17/106,745

(22) Filed: Nov. 30, 2020

Related U.S. Application Data

(60) Provisional application No. 62/943,979, filed on Dec. 5, 2019.

(51) Int. Cl.
*E21B 43/10* (2006.01)

(52) U.S. Cl.
CPC ..... *E21B 43/103* (2013.01); *E21B 43/101* (2013.01)

(58) Field of Classification Search
CPC ..... E21B 42/101; E21B 43/103
See application file for complete search history.

(56) References Cited

U.S. PATENT DOCUMENTS

| | | | |
|---|---|---|---|
| 4,778,553 | A | 10/1988 | Wood |
| 5,176,207 | A | 1/1993 | Keller |
| 5,246,862 | A | 9/1993 | Grey et al. |
| 5,377,754 | A | 1/1995 | Keller |
| 5,725,055 | A | 3/1998 | Schirmer |
| 5,803,666 | A | 9/1998 | Keller |
| 5,804,743 | A | 9/1998 | Vroblesky et al. |
| 5,853,049 | A | 12/1998 | Keller |
| 6,026,900 | A | 2/2000 | Keller |
| 6,109,828 | A | 8/2000 | Keller |
| 6,244,846 | B1 | 6/2001 | Keller |
| 6,283,209 | B1 | 9/2001 | Keller |
| 6,910,374 | B2 | 6/2005 | Keller |
| 7,281,422 | B2 | 10/2007 | Keller |
| 7,753,120 | B2 | 7/2010 | Keller |
| 7,841,405 | B2 | 11/2010 | Keller |
| 7,896,578 | B2 | 3/2011 | Keller |
| 8,069,715 | B2 | 12/2011 | Keller |
| 8,176,977 | B2 | 5/2012 | Keller |
| 8,424,377 | B2 | 4/2013 | Keller |
| 9,008,971 | B2 | 4/2015 | Keller |
| 9,534,477 | B2 | 1/2017 | Keller |
| 9,797,227 | B2 | 10/2017 | Keller |
| 10,030,486 | B1 | 7/2018 | Keller |
| 10,060,252 | B1 | 8/2018 | Keller |
| 10,139,262 | B2 | 11/2018 | Keller |

(Continued)

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.

(Continued)

*Primary Examiner* — D. Andrews
*Assistant Examiner* — Yanick A Akaragwe
(74) *Attorney, Agent, or Firm* — Rod D. Baker

(57) ABSTRACT

A method and system for steering the direction of propagation of a flexible liner everting under a driving fluid pressure. There is provided a method for controlling and guiding directionally the eversion of the flexible liner into a borehole that penetrates a subsurface (e.g., subterranean) void with a diameter substantially exceeding the nominal diameter of the borehole. Further, liner propagation by eversion can be controlled outside of a borehole and when unconstrained by a borehole, such as on or beneath the surface of a body of water.

26 Claims, 7 Drawing Sheets

(56) References Cited

U.S. PATENT DOCUMENTS

| | | | | |
|---|---|---|---|---|
| 10,337,314 | B2 | 7/2019 | Keller | |
| 10,472,931 | B1 | 11/2019 | Keller | |
| 2003/0113489 | A1* | 6/2003 | Smith | B29C 53/54 428/34.5 |
| 2004/0065438 | A1* | 4/2004 | Keller | E21B 49/008 166/250.03 |
| 2016/0348482 | A1* | 12/2016 | Keller | E21B 49/084 |
| 2020/0232292 | A1 | 7/2020 | Keller | |

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner (PRIOR ART)

METHOD FOR GUIDING THE DIRECTION OF EVERSION OF A FLEXIBLE LINER

CROSS-REFERENCE TO RELATED APPLICATIONS

This application claims the benefit of U.S. Provisional Patent Application Ser. No. 62/943,979 entitled "Method for Guiding the Direction of Eversion of a Flexible Liner," filed on 5 Dec. 2019, the entire disclosure of which is hereby incorporated by reference.

BACKGROUND OF THE INVENTION

Field of the Invention

This invention relates generally to flexible liners installed into subsurface boreholes, and particularly to a method and system for controlling and guiding directionally the eversion of a flexible liner into a borehole that penetrates a subsurface void with a diameter substantially exceeding the nominal diameter of the borehole. Further, propagation by eversion can be controlled outside of a borehole when not constrained by the borehole and in an environment such as on or beneath the surface of a lake.

Background of the Invention

Everting flexible liners are used for a wide variety of underground measurements as described in previous patents to this applicant, such as U.S. Pat. Nos. 5,176,207, 6,283,209, 6,910,374, 7,896,578, and 10,337,314—which are incorporated herein by reference. One common application is the installation of liners in vertical or angled boreholes. Other applications are described hereafter that are aided in guidance and orientation by the disclosed system and methods.

Everting liners are occasionally installed in boreholes that are not of uniform diameter. The variations in the borehole diameter may be because the borehole passes through subsurface voids, such as natural caves, caverns, or solution channels in limestone formations (known as Karst formations). Such voids may have any of a wide variety of sizes exceeding the diameter of the intended borehole. Other variations and inconsistencies in diameter are due to unstable layers in the formation such as layered basalt flows, in which weak layers slough into the borehole as it is being drilled. An advantage of a flexible liner is that it seals those portions of the borehole which are not enlarged.

However, if the borehole is enlarged more than a small fraction of the nominal diameter, the everting liner can be entrapped on a ledge within the enlargement void, or in the case of a relatively large enlargement (e.g., a void horizontal extent more than approximately twice the nominal diameter of the borehole), the liner does not travel into the open borehole beyond (e.g., on the opposite side of) the enlargement void. A typical liner may become entrapped because it does not evert in a straight path through an enlargement void; it may need the constraint of the borehole wall to propagate in the axial direction of the drilled hole. One cause for the everting liner to deviate from a proper path of propagation (i.e., coaxially with the borehole) is that the liner, as normally constructed, has variable longitudinal tensile strength in its circumference. For example, the seam welded into a common liner reinforces the liner along the path of the seam and essentially doubles the longitudinal tensile strength of the liner in the width of the seam. Such asymmetry in the circumferential tensile strength causes the liner to curve as it propagates (when unconstrained by a borehole wall). At other times the guidance provided is dependent on the orientation of the liner when the guiding method is applied, such as when the liner is being everted across the surface of a lake, pond, or other body of water, or when beneath the surface of the lake (e.g., on and along the lake bottom).

SUMMARY OF THE INVENTION

The present method, system and apparatus allows an everting liner to propagate more nearly in a straight path when unconstrained, to avoid entrapment during eversion in a borehole having enlargement voids in the borehole. A further, alternative, aspect of the invention is to selectively control the circumferential effective longitudinal tensile strength distribution of the liner, for the purpose of deliberately enhancing a curvature of the liner propagation to follow an intended non-linear (e.g., arcuate) path, thereby to steer the direction of propagation of an everting liner either vertically, horizontally or other preferred direction while maintaining the preferred orientation of an everting liner. This system and method permit a liner to be steerably everted, for example, from a vertical borehole into a non-vertical pipe. The invention also includes a system and method for guiding or steering the propagation of a flexible liner that is everting while floating on the surface of a body of water, or while everting upon the bottom of a body of water, such as the bed of a lake or pond.

Also according to the invention, the ability to control the direction of eversion is not limited to tendons in the circumference of the liner, but also by a mechanism described for leading the everting liner in the desired direction when there is access to the everting end of the liner, such as may be available in a borehole with an entrance and exit. Finally, the guidance through a large cavern can be a combination of the liner reinforcements to cause the liner to propagate in a straight line and by use of a weight attached to a sheave beneath the everting liner to further encourage a vertical travel path and to enhance the mechanism of eversion. The combination of the several features described allows the everting liner to propagate in the direction of preferred travel of the everting liner in a wide variety of circumstances with or without the ability to visibly observe the direction of travel.

BRIEF DESCRIPTION OF THE DRAWINGS

The attached drawings, which form part of this disclosure, are as follows.

The figures are not necessarily to scale, either within a single view or between views.

DESCRIPTION OF THE INVENTION

Figure 1:
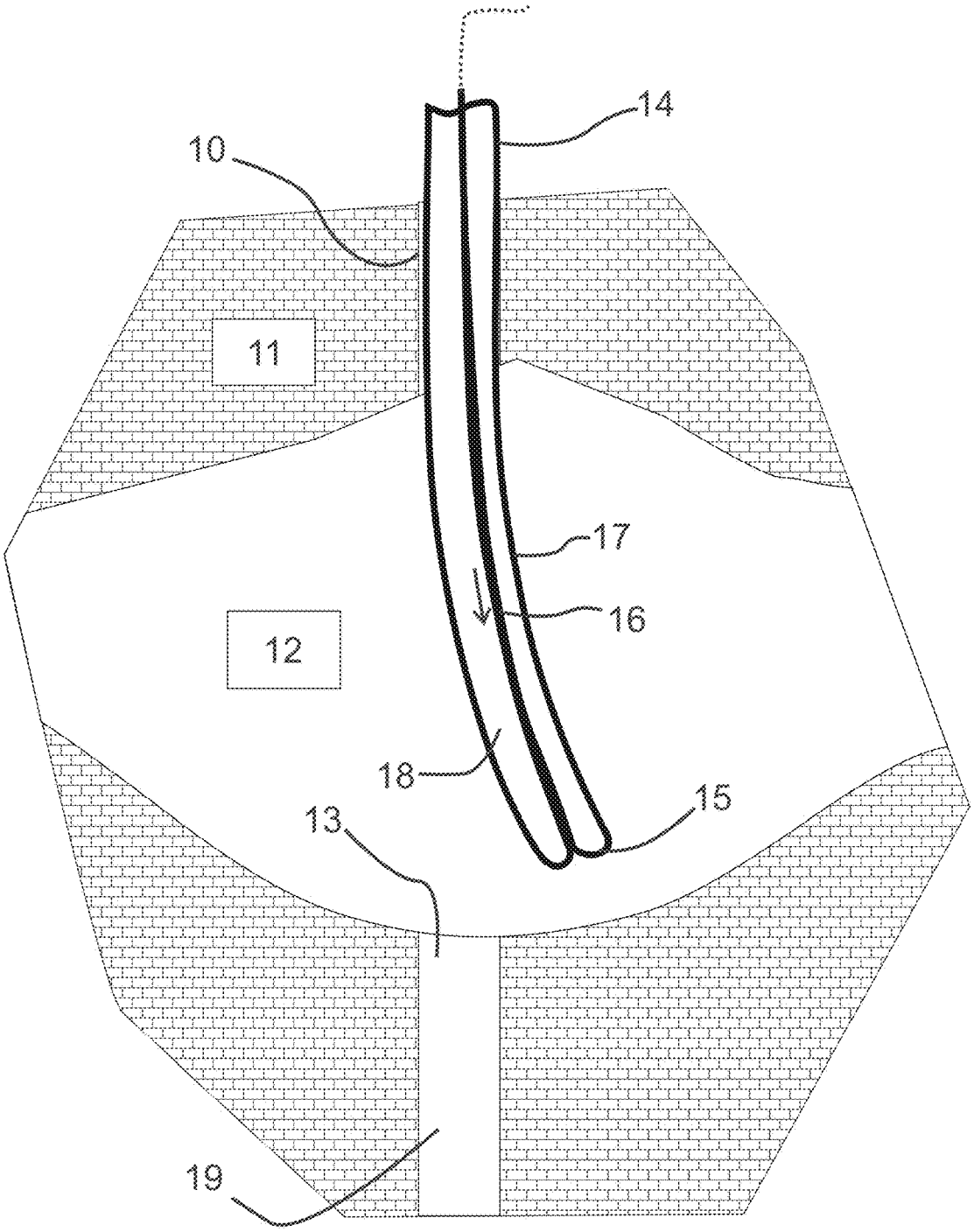
FIG. 1 is a side sectional view of an everting liner propagating from an upper segment of a subsurface borehole and into a subsurface enlargement void or cave.

FIG. 1 shows a borehole 10 extending through a subsurface geologic formation 11, passing through a cavern or void 12 in the formation, and including a lower borehole portion 19 into the floor of the void 12 beneath the void. A flexible liner 14 is being everted down the borehole's first (or upper) portion 10, toward its second (or lower) portion 19. The liner interior 18 is pressurized by a fluid, commonly water, that applies a pressure against the inside 22 (FIG. 2A) of the liner 14 equally everywhere, but especially at the eversion point at the liner's distal end 15. The internal pressure against the everting distal end 15 of the liner 14 causes the liner to extend axially, stretching it generally in the direction of liner propagation. (The liner 14 tends to stretch, throughout its circumference, due to liner weight and especially weight pressure of the water within the liner.) The borehole portions 10, 19 are separated by the intermediate enlargement void 12.

Referring still to FIG. 1, it is seen that in past practice as the flexible liner 14 everts at its distal end 15, by the advancing of the inverted portion 16 of the liner into the enlargement void 12, the liner 14 often curves after entering the void. Unconstrained by the borehole wall, the tubular liner 14 tends to evert as a "curved cylinder" with an arcuate axis and an arcuate "generatrix." This curvature 17 in the path of eversion is attributable to a seam tape used in construction of a conventional liner 14. The seam tape (e.g., seam tape 21 in FIG. 2A) is on the inside (typically) of the liner 14, longitudinally along the liner wall and along the liner's arc of maximum curvature. (That is, the tube of the liner 14, unconstrained in the void 12, tends to propagate along an arcuate path as seen in FIG. 1, with the seam tape 21 disposed along that length (an element of the curved generatrix) of the liner wall which defines an arc of minimal diameter in relation to all other axial lengths of the liner wall.)

Figure 2A:
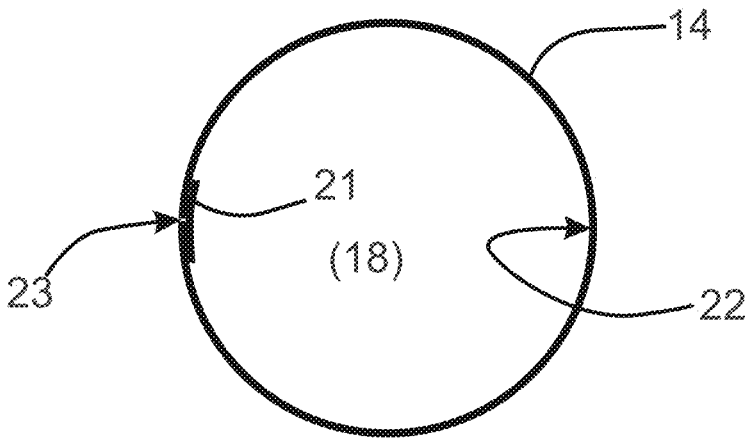
FIG. 2A is a transverse (axial) cross sectional view of a conventional flexible liner, showing the typical seam as welded along the length of the liner during liner fabrication.

Again, this curvilinear bending 17 of the path of liner eversion is due to the reinforcing effect of the seam tape 21, which increases the tensile strength (resistance to longitudinal stretching) of the liner wall; i.e., the seam tape 21 as shown in FIG. 2A adds to the longitudinal strength of the liner 14 fabric. The additional strength imparted by the seam tape 21, however, causes the liner 14 to curve if unsupported by the borehole 10. The least radius of liner curvature defines the arc of liner wall contacting or including the seam tape 21, because it is this (reinforced) arc of liner wall that undergoes the least amount of longitudinal stretching. Consequently, the liner 14 tends to propagate along a curved path as seen in FIG. 1

As the liner 14 everts at its distal end 15 and into/through the void 12, the curved path of propagation causes the liner to diverge from being coaxial with the borehole portions 10, 19, and prevents the liner from entering the lower borehole opening 13 at the mouth of the lower borehole portion 19 beneath the void. Thus out of alignment with the lower borehole portion 19, the liner 14 cannot enter the lower borehole opening 13 and accordingly cannot propagate into the lower borehole portion 19 below the floor of the void 12. Such inability to enter the borehole opening 13 beneath the void 12 undesirably prohibits eversion of the liner 14 into the lower borehole portion 19 to depths below the floor of the void.

FIG. 2A shows a typical cross section of a known flexible borehole liner 14 fabricated with a sealed seam 23. The seam 23 exists because the liner 14 is fabricated from a flat, coated, fabric that is "rolled" and its edges joined to define a tube. As the fabric is joined at the seam 23 to form a tubular liner 14, a seam tape 21, usually of the same fabric, is welded to the liner material to seal the seam 23 and to keep airtight (and/or watertight) the tubular configuration. The seam tape 21 typically doubles the fabric thickness (i.e., thickness of the liner wall) at the seam 23, and therefore enhances the strength of the liner 14 to resist the longitudinal tension in the liner in the axial direction of the seam tape 21. Such reinforcement resists stretching of the liner 14 when a tension force is applied in the direction of the seam 23 (as is provided by the interior pressure 18 of the liner 14 against the inverted end 15). The foregoing effect causes the liner 14 to stretch less at the seam 23 for the applied tension. This difference in stretch causes the liner 14 to curve as it propagates by eversion when not supported by the borehole wall 10, as explained previously above.

Figure 2B:
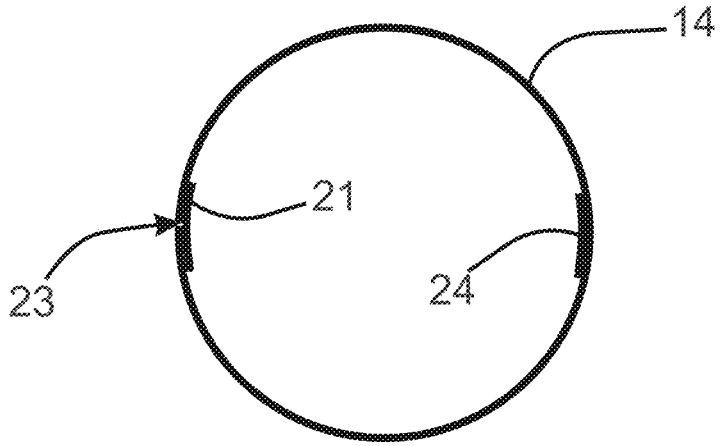
(Prior Art) FIG. 2B
FIG. 2B is a transverse (axial) cross sectional view of a flexible liner according to the present invention, showing the typical seam as welded along the length of the liner during liner fabrication according to FIG. 2A, but also showing a second reinforcement tendon on the liner.

Attention is advanced to FIG. 2B, introducing a first and simplest embodiment of the present system and method. To prevent the curvature 17 (FIG. 1) in an unconstrained everting liner due to the seam tape 21, according to the present apparatus and method a second reinforcing means, or "tendon" 24, is affixed to the inside of the liner 14 along its longitude. The reinforcement tendon 24 is installed along the full length of the liner, and preferably diametrically opposite the seam tape 21 as shown in FIG. 2B. The tendon 24 preferably is formed of the same seam tape 21 used to close the sealed seam 23. There normally is not a second actual seam in the liner wall, but only a second reinforcing means 24 of the liner wall substantially equal to the longitudinal reinforcement supplied by the first seam tape 21. This tendon 24 is affixed, e.g. by welding, to the interior of the liner 14 diametrically opposite (180° degrees radially) from the seam 23 and main seam tape 21. The tendon 24 is welded to the liner 14, usually with RF welding, to provide a substantially identical reinforcement of the liner 14 as provided by the seam tape 21. The diametrically opposite sides of the liner 14 thus are equally reinforced longitudinally. The presence of the reinforcing tendon 24 balances tension forces in the liner, and serves to ameliorate or eliminate the tendency of the liner to curve when everting through a void.

Figure 3:
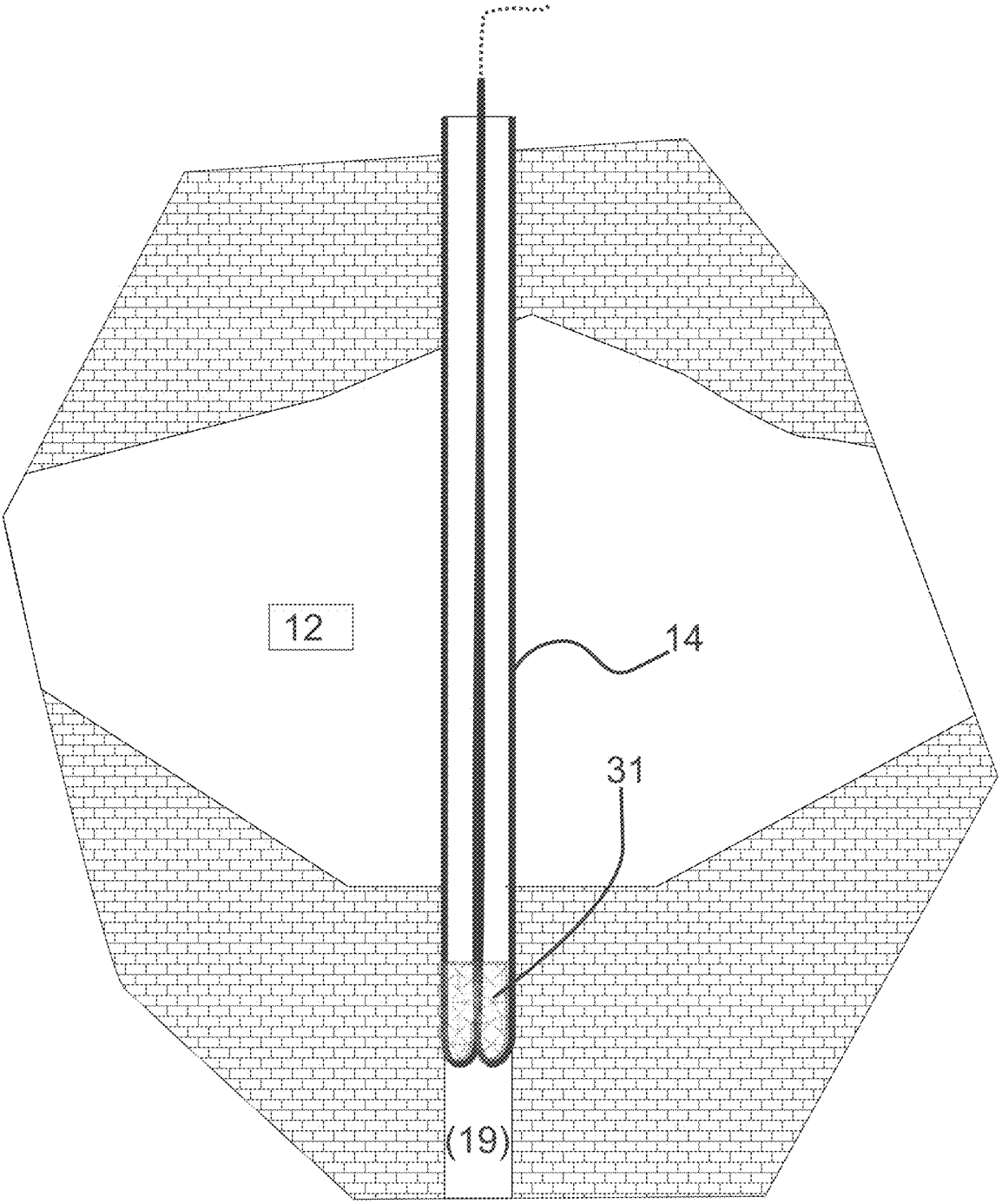
FIG. 3 is a side sectional view of a system and apparatus according to the invention, illustrating a path of a liner everting across a subsurface enlargement void and into a distant borehole, as aided by the tendon (FIG. 2B) and a mud slug.

FIG. 3 illustrates that, by the present invention (per apparatus of FIG. 2B), the intended eversion of the liner 14 is directly and substantially linear from the upper borehole 10 towards and into the lower borehole opening 13 in the floor of the void 12, opposite/below the upper borehole. I have observed this behavior of the liner's eversion when a tendon 24 has been added to the liner 14 as described above; the liner propagates linearly (e.g., essentially vertically downward in the example of FIG. 3) along the coaxes of the upper 10 and lower 19 portions of the borehole. Also shown in FIG. 3 is the use of an optional short slug of heavy mud 31 within the everted portion of the liner. The slug of heavy mud 31 may be added to the lower interior of the liner 14 to promote two advantages. Such heavy mud 31, often composed of a bentonite slurry with a powdered barium sulphate addition to increase its density, adds to the force against the everting end 15 of the liner 14, and thus encourages the distal end of the liner to propagate vertically directly downward (i.e., under the force of gravity, similar to a plumb bob). The mud 31 addition is not indicated if the borehole portions 10 and 19 are not vertically aligned, because the mud 31 would cause the liner 14 to droop and diverge from the borehole axis, rather than propagating in a straight line.

Figure 4:
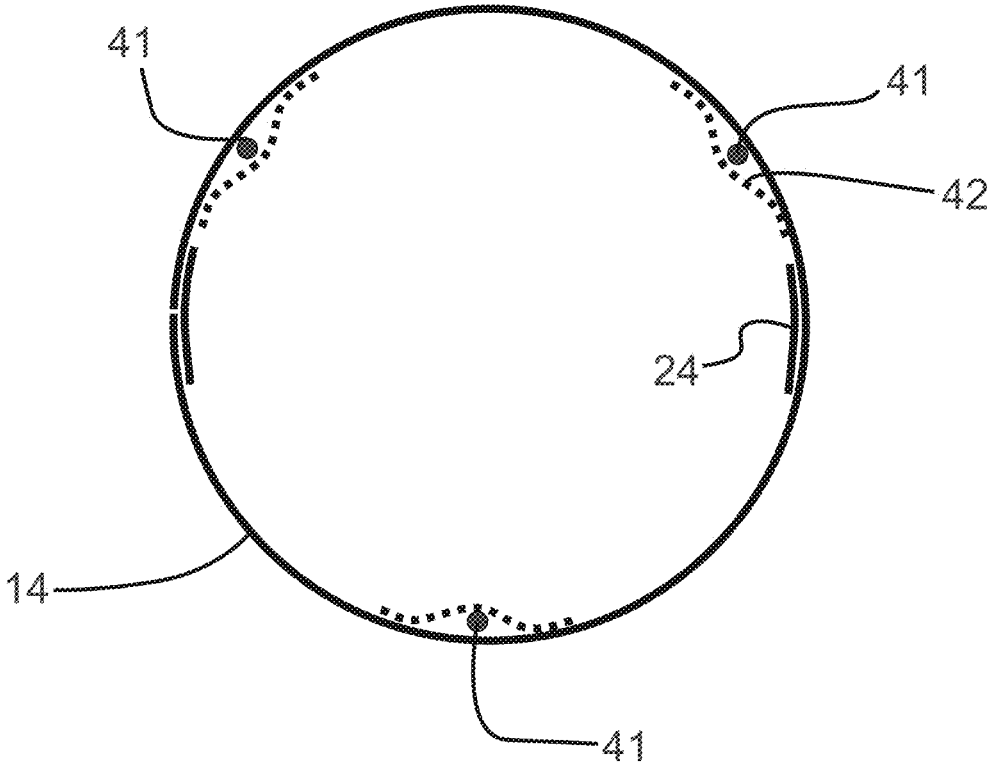
FIG. 4 is an enlarged transverse (axial) cross sectional view of a flexible liner, showing tube sleeves welded to the interior of the liner and containing tubing or guide cords, according to the present invention.

FIG. 4 shows an extension of the basic concept of the addition of a reinforcing tendon 24. Many flexible liners 14 deployed in the subsurface have tubing 41 contained in interior sleeves 42 welded to the interior of the liner 14. Such tubing 41 normally is used in cooperation with a pump to lift sample fluids to the ground's surface, or less commonly may be used to inject liquids to the subsurface. Care must be exercised to prevent the curvature of the liner 14 due to the added strength of the sleeves 42; one or more tube-holding sleeves 42 can have a liner-reinforcing effect similar to that described for a seam tape 21, as described above. For that reason, according to the present invention any interior sleeves 42 preferably number at least two, and are arranged with an angular symmetry around the liner's central axis. (While there preferably are two sleeves containing two tubes, a less versatile embodiment having a single sleeve and single tube is within the scope of the present invention.) Two sleeves 42 preferably are disposed diametrically opposite each other. Or, as shown in FIG. 4, three sleeves 42 are arrayed with 120 degrees separating adjacent sleeves. In an embodiment of a liner 14 provided with four interior sleeves 42, the sleeves are uniformly spaced by 90 degrees. In sum, any even number of sleeves 42 included on the flexible liner 14 are arrayed in pairs, with each sleeve of a pair disposed diametrically opposite the other sleeve of the pair. In the case of an odd number of sleeves, the sleeves are disposed equally spaced radially. Thus in all embodiments the radial spacing in degrees preferably is given by $$S = \frac{360}{N}$$

where S is the radial spacing in degrees, and N is the number of sleeves. According to the foregoing, the longitudinal reinforcing effects of the sleeves 42 are balanced, thereby promoting a linear propagation of a sleeve-equipped liner when unconstrained by a borehole wall.

It is noted that the tubing 41 (within and along the sleeves 42) could also "reinforce" the liner 14 asymmetrically, except that the tubing 41 is not attached to the liner 14. But at the moving everting end of the liner 15, the tubing 41 is sharply curved (i.e., is momentarily bent through about 180 degrees) within the sleeves 42, resulting in frictional contact between tube 41 and an adjacent segment of liner and/or sleeve. This frictional contact potentially produces a temporary but heavy drag on the liner 14 and the sleeves 42, creating the same effect as if the tube 41 were weakly welded to the liner 14. Generally, that friction is not a significant effect.

Figure 5:
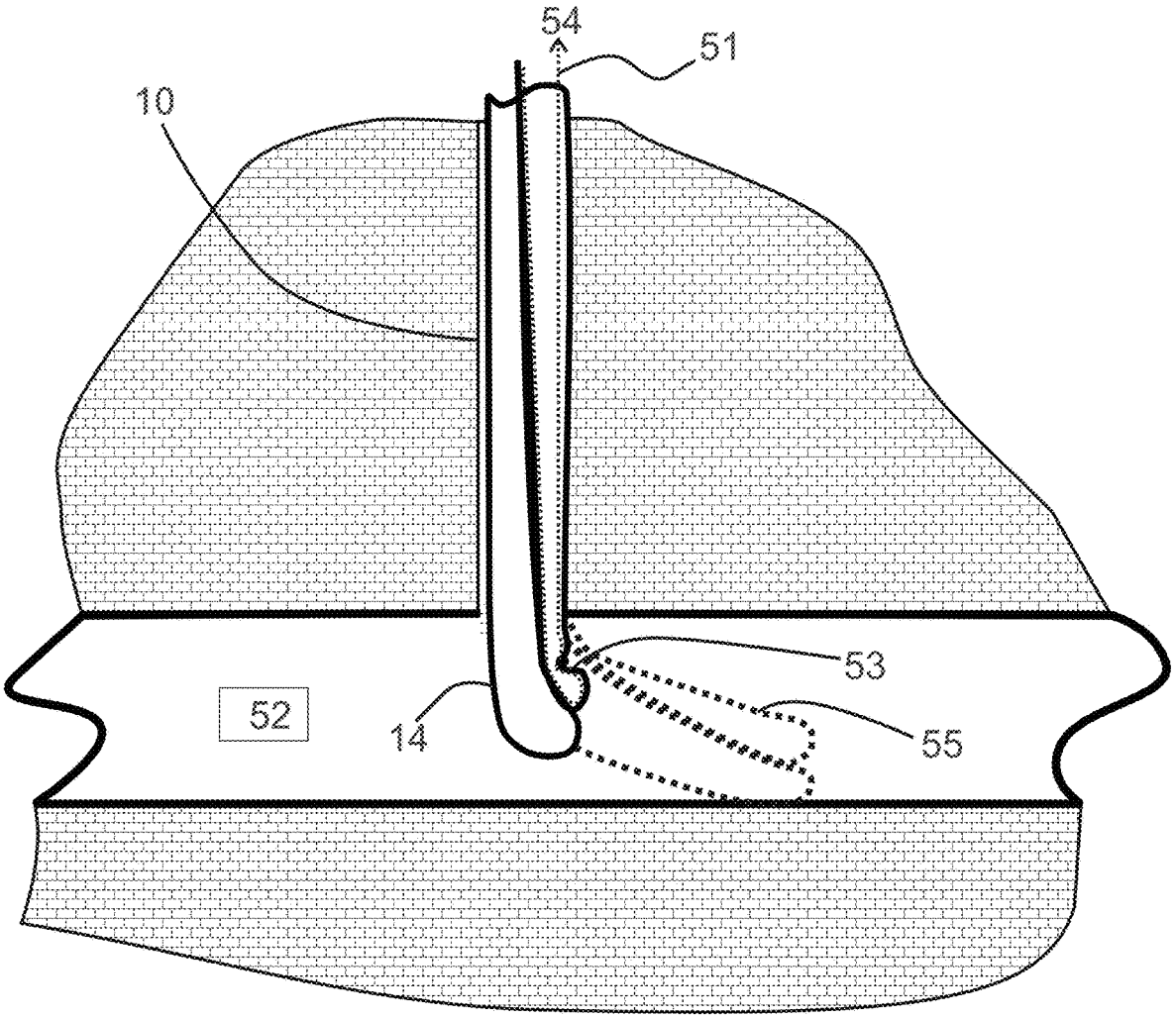
FIG. 5 is a side sectional view of a mostly vertical borehole or conduit intersecting a substantially horizontal or slightly sloping subsurface pipe, and illustrating a system or method according to the present invention for guiding a flexible liner along a non-linear propagation path from the borehole and into the pipe.

However, a conceptual extension of the effect of a reinforcement (e.g., a tube or cord) within a sleeve 42 can be exploited to permit a user to deliberately generate a curved path of liner propagation. In this alternative embodiment, the tube 41 may be a true hollow tube, or preferably a tube is replaced with a cord strong in tension (i.e., cord 51 in FIG. 5). FIG. 5 illustrates such a desirable effect, whereby control cords within one or more interior sleeves 42 can be manipulated (from the ground surface above a borehole 10) to intentionally induce, and regulate, a curved propagation of an everting liner 10. In order to use that effect to advantage, a tube 41 of FIG. 4 preferably is replaced with, or accompanied by, a low friction control cord 51. (Each sleeve 42 has a control cord within and along its length.)

Further reference is made to FIG. 5, in view of FIG. 4. At least one, preferably two or more, control cords 51 of low exterior friction, but high strength (such as a cord fabricated from Spectron™ material woven into tubular form) is situated in the liner 14. Each of one, preferably a plurality of two or more, sleeve(s) 42 affixed on the liner wall is provided with a control cord 51 slidably situated along and within the sleeve's interior. The proximate end of a control cord 51 is accessible and controllable (by pulling a tension force thereon) above the ground's surface at the top of the borehole 10. The control cord 51 also is frictionally engaged with and at the wall of the liner 14 and/or the sleeve 42 at the (moving) everting end (e.g., end 15 in FIG. 1) of the liner. If the liner 14 is propagating through a (e.g., generally vertical) borehole 10 and then into a generally horizontal pipe 52, and it is desired that the liner 14 turn and evert into and along the pipe 52, the cord 51 in the sleeve 42 can be tensioned 54 to produce the effect illustrated in FIG. 5. By selectively applying the tension force 54 to a control cord 51 in a sleeve located on the side of the liner corresponding to the compass direction of desired liner propagation, an operator at the ground's surface can induce a change in the liner's direction of eversion. Tension force 54 can be generated by any suitable means, including manually by operators, or with a powered reel, at the ground's surface.

As illustrated in FIG. 5, an applied tension 54 in the control cord 51 (on right side of liner 14) causes the liner to bend on the side of the applied tension (again, the right side as seen in the figure) to form a crook or buckle 53 in the liner 14. If such a buckle or bend 53 were not formed, the liner 14 would evert directly against the bottom side of the pipe 52 directly below the borehole 10, and then stop everting. By deliberately forming temporarily the bend or buckle 53 in the liner 14, the liner everts in the azimuth, or compass, direction of the bend 53. When the applied tension 54 is thereafter controllably released, the liner 14 propagates (everts) horizontally along the pipe or culvert 52, as is usually desirable. The subsequent extension and continuing horizontal propagation of the liner 14 along the pipe 52 is illustrated in phantom by the dashed form 55 of the everting liner seen in FIG. 5.

In yet another situation requiring the guidance of the liner, a liner must be oriented azimuthally about its central axis during propagation. Stated differently, the liner must remain oriented generally constant relative to vertical, and not roll or rotate around its longitudinal axis. For example, orientation of the liner is important when a liner is everted over the surface of a body of water. In that case, if the liner is to be deflected to the right or left, the liner should be oriented azimuthally about the central axis of the tubular liner such that the guiding tendons in the interior sleeves are on the right or left side of the liner. Gravitational and/or buoyancy forces may be exploited to maintain the proper liner orientation.

Figure 6:
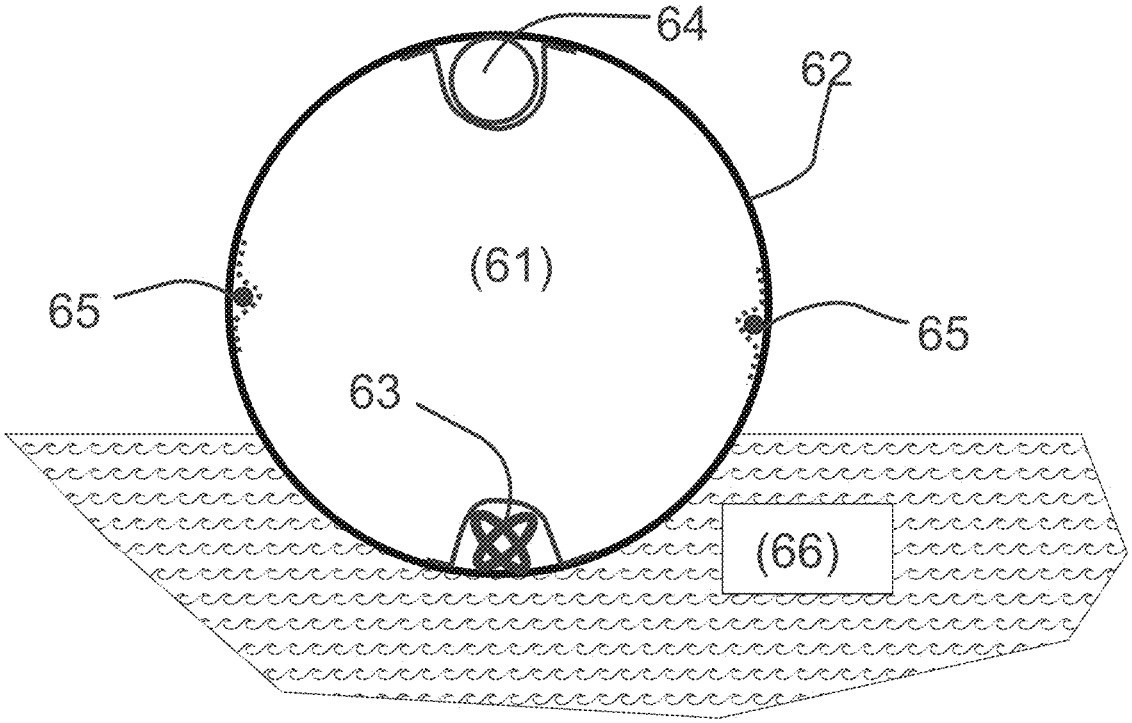
FIG. 6 is a cross sectional view of a flexible liner with a weighted or buoyant member according to an alternative embodiment of the present invention, to control the orientation of the liner as the guidance mechanism is employed.

Liners propagated along the surface of a water body usually are everted by air pressure, and the everting liner floats on the water's surface. FIG. 6 depicts such an air-driven liner 62 with a linear yet flexibly bendable weight 63, such as an iron chain, contained in an interior bottom sleeve (e.g., sleeve 42 of FIG. 4) welded inside the liner. The flexible weight 63 is sufficiently flexible that it can evert with the liner 62. A chain as a weight 63 causes the air-filled interior 61 of the liner 62 to float at the surface of water 66, with the flexible weight on the bottom of the liner, in the bottom sleeve, slightly below the water's surface. Applying a tension force to the appropriate one of at least two steering control cords 65 (interior to the sleeves on the right or left side of the liner 62) causes the liner to evert in the direction of the tauter cord, as shown in FIG. 5, but on the surface of the water 66.

A further extension of the same concept is if the liner 62 has a flexible weight 63 that is an iron chain, and the liner interior is filled with water 61 as the driving fluid under pressure. The chain 63 causes the liner 62 to sink to the bottom of the water body 66, such as in a shallow lake. The liner 62 can be everted along the bottom of the lake or pond, and its direction of propagation controlled; the liner is steered by deliberately pulling on a respective one of the steering control cords 65. Applying tension force to the proximate end of one of the steering control cords (i.e., either right or left) turns correspondingly the liner's curved direction of propagation to the right or to the left. After the liner has been turned sufficiently to the right or left, the tension force may be selectively released to permit the liner to propagate further linearly.

To further encourage the liner 62 to remain oriented with the chain 63 along the lowermost side of the liner 62, an air-filled tube 64 optionally can be provided in an upper sleeve on the uppermost side of the liner 62 diametrically opposite the bottom sleeve containing the flexible weight 63. These flexible members 63 and 64 can be everted with the liner 62. The buoyancy of the air-filled tube 64 in combination with the weight member 63 tends to maintain the liner oriented with the air-filled tube directly above the flexible weight 63, such as a chain. This combination of buoyant tube 64 and heavy chain 63 keeps the liner 62 properly oriented vertically as it travels along the bottom of the lake (for example), while the direction of travel can be controlled by adjustment of the tension in the cords 65 in the sleeves attached to the interior of the liner 62.

A person skilled in the art notes that the liner 62 may first be filled with air and then guidable floated along the surface of the body of water, and subsequently then be filled internally with water to cause the liner to sink to the bottom of the body of water. The liner can thus be guided into place upon the water's surface, to a desired arrangement and location above the bottom of the lake or pond, and then deliberately sunk in place. Continued propagation along the bottom of the body of water can be guidably continued according to the modes and systems described, while driving with water the liner eversion.

Figure 7:
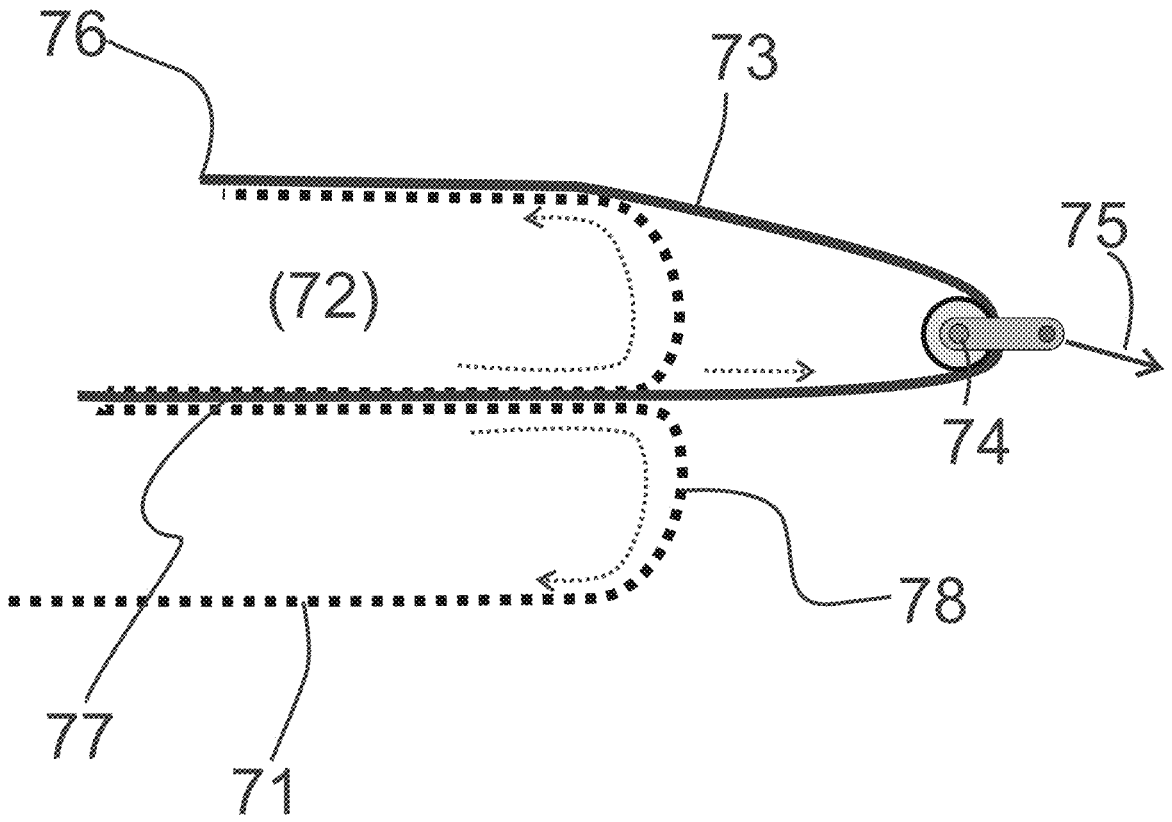
FIG. 7 is a side sectional diagrammatic view of a means, according to the present invention, for controlling the direction of propagation of a liner by application of a tension in the direction of the preferred travel of the everting liner.

FIG. 7 shows another means for controlling the direction of the liner eversion, which offers the advantage of facilitating the eversion of the liner. The liner 71 shown in FIG. 7 can be driven with a pressurized water fill (72) across a land surface, or within the interior of a crooked pipe. A strap 73 where interior to the liner 71 (at locations 77) is anchored at the proximal end 76 of the liner where the eversion is initiated, and the driving fluid 72 is injected into the interior of the liner 71. For a lake surface, the driving fluid 72 would best be air. For a propagation through a pipe, the driving fluid 72 pressure may be provided with air or water. By applying a tension force 75 upon a pulley 74 containing the strap 73 enclosed in the inverted interior 77 of the liner 71, the liner eversion can be directed across a lake surface as described above, or through a series of turns in a pipe (not shown). In the first example of propagation across the surface of a body of water, the tension 75 may be applied by cable extending to a boat leading the liner 71 as it everts. An example of such an application may be to deploy a floating air-filled liner 71 to encompass and contain an oil spill on the water's surface.

The advantages of the method are several. The pressure within the everting liner interior propels the propagation of the liner 71. And if the liner 71 is propagating across a land surface (not shown), a driving fluid 72 of water, rather than air, can conveniently provide a water source at the end of the everted liner. In the latter case, the liner 71, when fully extended, can become a water hose to supply water at a remote location. This is an advantage over conventional circumstances where the weight of an ordinary hose would prohibit the simple dragging of the hose over difficult terrain to the location where the water supply is needed, as in a fire fighting situation. The everting liner 71 can propagate over hilly terrain, or up a stairwell. In another application, the interior air-filled tube 64 (FIG. 6) can subsequently be utilized as a high pressure hose to conduct water or other fluids to the location of the end of the fully everted liner. If/when the liner 71 is deflated and the interior tube 64 is extracted through a slit in the liner, the tube 64 can also be used as a hose for a flow of various fluids at any point along the everted liner 71. (Such a slit in the liner, however, renders it impossible to continue the eversion.)

The strap 73 of FIG. 7 preferably and advantageously is formed of a common urethane-coated webbing. An advantage is that the urethane coated strap 73 has a very high friction coefficient in contact with a typical urethane-coated liner 71 at the inverted interval 77. With tension 75 applied to the pulley 74, such frictional engagement between the strap 73 and liner 71 promotes the liner eversion by pulling the inverted portion 77 of the liner toward the everting end 78 of the liner. The tension 75 offsets the drag normally existing between the interior inverted interval 77 of the liner and the inside surface of the everted portion of the liner 71. Drag between the inverted interval of the liner 77 and the everted length of liner 71 is especially high as the liner bends in its turning. Without the high friction of the strap 73 on the inverted interval of liner 77, excessive tension has been known to cause the inverted interval 77 of the liner to buckle, if the strap 73 were instead a slippery cord that can slip inside the inverted interval of the liner 77. The pressurized interior of the liner 71 causes the inverted interval 77 of the liner to be strongly urged against the strap 73, thereby further preventing slipping of the strap 73 inside the inverted interval 77 of the liner 71.

These methods of controlling the direction of the liner eversion are important to the application of the everting liner mechanism. The control of the direction of the everting liner, and the aid in overcoming the drag of the inverted interval 77 of the liner against the everted interval of the liner 71, are helpful to the eversion process and reduce the pressure of the driving fluid 72 otherwise required to propagate the eversion of the liner. The ability to keep the liner oriented with the weight in the sleeve, and the buoyant tube, is useful for the ease of guidance for other applications of everting liners not described herein. The everting liner has many applications as described in my issued patents, including those cited herein above.

The foregoing descriptions of the systems of the invention enable a method. Processes according to the present invention nevertheless may be additionally characterized. In accordance with this disclosure, a method is provided for deploying the flexible tubular liner having a sealed seam running along its length. One preferred such method includes the steps of providing at least one reinforcing means along the length, equi-spaced radially from the sealed seam; sealably fastening a first end of the inverted flexible liner to a point of origin; injecting fluid into the liner interior to induce eversion; and propagating the liner while allowing the liner to evert at a moving eversion point. The fluid may be water or (less typically) air. "Deploying a flexible tubular liner" preferably includes the step of installing the liner into a subsurface borehole, wherein providing at least one reinforcing means comprises the step of affixing a reinforcement tendon or tape diametrically opposite the sealed seam. In this embodiment, the borehole has a first portion separated from a second portion by an intermediate enlargement void, there being a borehole opening into the second portion; propagating the liner accordingly features a step of everting the liner linearly to propagate coaxially with the upper portion and the lower portion, through the enlargement void toward the borehole opening. Typically, the first portion and the second portion are substantially vertically aligned, and the method optionally may include the step of adding a slug of heavy mud into an interior of the everting liner.

In a preferred version of the method, "providing at least one reinforcing means" further includes the steps of affixing at least two sleeves on a liner wall and situating a control cord within and along each sleeve, with the control cord having a proximate end at the point of origin; in this embodiment, the sleeves normally are equispaced radially on the liner wall according to the formula $S=360/N$, wherein S is the radial spacing in degrees, and N is the number of sleeves.

In the method, "propagating the liner while allowing the liner to evert" may also include the steps of intentionally inducing and regulating a curved propagation of the liner. In this embodiment, inducing and regulating a curved propagation may feature the steps of allowing a first control cord to frictionally engage (at the moving eversion point) with the liner wall and/or a first sleeve located on a side of the liner corresponding to a compass direction of desired liner propagation, and selectively applying a tension force to the proximate end of the first control cord. By this version of the method, "inducing and regulating a curved propagation" may include the steps of propagating through a generally vertical borehole, then turning the liner into a generally horizontal pipe at the compass direction, and then everting the liner along the pipe.

In an alternative embodiment of the method, "propagating the liner while allowing the liner to evert" may include the steps of everting the liner with pressurized air, containing in a bottom sleeve a linear flexibly bendable weight along the length of the liner, and then floating the liner on the surface of a body of water with the bendable weight disposed along the lowermost side of the liner. In this embodiment, "inducing and regulating a curved propagation" may include the steps of allowing a first control cord to frictionally engage, at the moving eversion point, with the liner wall and/or a first sleeve located on the right side of the liner, and then selectively applying a first tension force to the proximate end of the first control cord to steer the curved propagation to the right. Accordingly, "inducing and regulating a curved propagation" similarly may include the steps of allowing a second control cord to frictionally engage, at the moving eversion point, with the liner wall and/or a second sleeve located on the left side of the liner, and then selectively applying a second tension force to the proximate end of the second control cord to steer the curved propagation to the left.

Thus, the direction of liner propagation can be controlled by steering the liner alternately to the left or to the right. Accordingly, "inducing and regulating a curved propagation" alternatively may include the steps of allowing a first control cord to frictionally engage, at the moving eversion point, with the liner wall and/or a first sleeve located on the left side of the liner, and selectively applying a first tension force to the proximate end of the first control cord to steer the curved propagation to the left.

According to another embodiment of the method, "propagating the liner while allowing the liner to evert" may include the further steps of containing in an upper sleeve, diametrically opposite the lower sleeve, an air-filled tube along the length of the liner, and floating the liner on the surface of a body of water, with the air-filled tube disposed along the uppermost side of the liner—thereby encouraging the liner to remain oriented with the bendable weight disposed along the lowermost side of the liner. By this method, there may be the added step of subsequently utilizing the air-filled tube as a pressurized hose to conduct a fluid to a location at an end of the fully everted liner. After floating the liner on the surface of a body of water, the method may then include added steps of filling the liner with water, causing the liner with the air filled tube and the weighted sleeve to sink to the bottom of the body of water body, and then driving the liner along the bottom of the water body with the liner oriented with the air filled tube along the top of the liner.

The foregoing disclosure is of several examples of the advantages of controlling of the direction of eversion of the liner. Because flexible liners can evert easily when unconstrained, as along the bottom of a lake or across the ground surface, it is useful to be able to control the direction of propagation. Helpfully, inflated flexible liners have very high resistance to torsion or twisting of the liner when under pressure. However, the directional controls can cause some reorientation of the liner. Therefore, it is possible to maintain, according to the present system and method, the orientation of an everting liner during extension. The control of the orientation of the liner also makes it easier to anticipate the effect of the directional controls.

Although the invention has been described in detail with reference to these preferred embodiments, other embodiments can achieve the same results. The present apparatus can be practiced by employing generally conventional materials and motors. Accordingly, the details of such materials, compositions, motors and pumps are not set forth herein in detail. In this description, if specific details are set forth, such as specific materials, structures, processes, etc., they are to provide a thorough understanding of the present invention. However, as one having ordinary skill in the art would recognize, the present invention can be practiced without resorting strictly only to the details specifically set forth. In other instances, well known processing structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concepts expressed herein. Thus, although the invention has been described in detail with particular reference to these preferred embodiments, other embodiments can achieve the same results. Variations and modifications of the present invention will be obvious to those skilled in the art and it is intended to cover with the appended claims all such modifications and equivalents. The entire disclosures of all patents cited hereinabove are hereby incorporated by reference.

I claim:

1. A method of deploying a flexible tubular liner, the flexible liner having a sealed seam running along its length, comprising the steps of:

providing at least one reinforcing means along the length, equispaced radially from the sealed seam to provide substantially identical reinforcement of the flexible liner as provided by the sealed seam, thereby balancing tension forces in the liner to ameliorate any tendency of the liner to curve while everting;

sealably fastening a first end of the flexible liner to a point of origin;

injecting fluid into the liner interior to induce eversion in the liner; and propagating the liner while allowing the liner to evert at a moving eversion point.

2. The method according to claim 1 wherein deploying a flexible tubular liner comprises installing the liner into a subsurface borehole, and wherein providing at least one reinforcing means comprises the step of affixing a reinforcement tendon or tape diametrically opposite the sealed seam.

3. The method according to claim 2 wherein the borehole has a first portion separated from a second portion by an intermediate enlargement void, there being a borehole opening into the second portion, and wherein propagating the liner comprises the step of everting the liner linearly to propagate coaxially with the first portion and the second portion, through the enlargement void toward the borehole opening.

4. The method according to claim 3 wherein the first portion and the second portion are substantially vertically aligned, and further comprising the step of adding a slug of heavy mud into an interior of the everting liner.

5. The method according to claim 1 wherein providing at least one reinforcing means further comprises:

affixing at least two sleeves on a liner wall; and situating a control cord within and along each sleeve, the control cord having a proximate end at the point of origin;

wherein the sleeves are equispaced radially on the liner wall according to the formula $$S = \frac{360}{N},$$

and wherein S is the radial spacing in degrees, and N is the number of sleeves.

6. The method according to claim 5 wherein propagating the liner while allowing the liner to evert comprises the steps of intentionally inducing and regulating a curved propagation of the liner.

7. The method according to claim 6 wherein inducing and regulating a curved propagation comprises the steps of:

allowing a first control cord to frictionally engage, at the moving eversion point, with the liner wall and/or a first sleeve located on a side of the liner corresponding to a compass direction of desired liner propagation; and selectively applying a tension force to the proximate end of the first control cord.

8. The method according to claim 7 wherein inducing and regulating a curved propagation further comprises the steps of:

propagating through a generally vertical borehole;

turning the liner into a generally horizontal pipe at the compass direction; and everting the liner along the pipe.

9. The method according to claim 6 wherein propagating the liner while allowing the liner to evert comprises the steps of:

everting the liner with pressurized air;

containing in a bottom sleeve a linear flexibly bendable weight along the length of the liner; and floating the liner on the surface of a body of water with the bendable weight disposed along the lowermost side of the liner.

10. The method according to claim 9 wherein inducing and regulating a curved propagation comprises the steps of:

allowing a first control cord to frictionally engage, at the moving eversion point, with the liner wall and/or a first sleeve located on the right side of the liner; and selectively applying a first tension force to the proximate end of the first control cord to steer the curved propagation to the right.

11. The method according to claim 10 wherein inducing and regulating a curved propagation comprises the steps of:

allowing a second control cord to frictionally engage, at the moving eversion point, with the liner wall and/or a second sleeve located on the left side of the liner; and selectively applying a second tension force to the proximate end of the second control cord to steer the curved propagation to the left.

12. The method according to claim 9 wherein inducing and regulating a curved propagation comprises the steps of:

allowing a first control cord to frictionally engage, at the moving eversion point, with the liner wall and/or a first sleeve located on the left side of the liner; and selectively applying a first tension force to the proximate end of the first control cord to steer the curved propagation to the left.

13. The method according to claim 9 wherein propagating the liner while allowing the liner to evert further comprises the steps of:

containing in an upper sleeve, diametrically opposite the lower sleeve, an air-filled tube along the length of the liner; and floating the liner on the surface of a body of water, with the air-filled tube disposed along the uppermost side of the liner thereby encouraging the liner to remain oriented with the bendable weight disposed along the lowermost side of the liner.

14. The method according to claim 13, further comprising the step of subsequently utilizing the air-filled tube as a pressurized hose to conduct a fluid to a location at an end of the fully everted liner.

15. The method of claim 13 further comprising, after floating the liner on the surface of a body of water, the steps of:

filling the liner with water;

causing the liner with the air filled tube and the weighted sleeve to sink to the bottom of the body of water body; and driving the liner along the bottom of the water body with the liner oriented with the air-filled tube along the top of the liner.

16. A method of deploying a flexible tubular liner, the flexible liner having a sealed seam running along its length, comprising the steps of:

providing reinforcing means along the length, equispaced radially from the sealed seam, comprising the steps of: affixing at least two sleeves on a liner wall; and situating a control cord within and along each sleeve, the control cord having a proximate end at the point of origin;

wherein the sleeves are equispaced radially on the liner wall according to the formula S=360/N, wherein S is the radial spacing in degrees, and N is the number of sleeves;

sealably fastening a first end of the flexible liner to a point of origin;

injecting fluid into the liner interior to induce eversion in the liner; and propagating the liner while allowing the liner to evert at a moving eversion point.

17. The method according to claim 16 wherein propagating the liner while allowing the liner to evert comprises the steps of intentionally inducing and regulating a curved propagation of the liner.

18. The method according to claim 17 wherein inducing and regulating a curved propagation comprises the steps of:

allowing a first control cord to frictionally engage, at the moving eversion point, with the liner wall and/or a first sleeve located on a side of the liner corresponding to a compass direction of desired liner propagation; and selectively applying a tension force to the proximate end of the first control cord.

19. The method according to claim 18 wherein inducing and regulating a curved propagation further comprises the steps of:

propagating through a generally vertical borehole;

turning the liner into a generally horizontal pipe at the compass direction; and everting the liner along the pipe.

20. The method according to claim 16 wherein propagating the liner while allowing the liner to evert comprises the steps of:

everting the liner with pressurized air;

containing in a bottom sleeve a linear flexibly bendable weight along the length of the liner; and floating the liner on the surface of a body of water with the bendable weight disposed along the lowermost side of the liner.

21. The method according to claim 20 wherein inducing and regulating a curved propagation comprises the steps of:

allowing a first control cord to frictionally engage, at the moving eversion point, with the liner wall and/or a first sleeve located on the right side of the liner; and selectively applying a first tension force to the proximate end of the first control cord to steer the curved propagation to the right.

22. The method according to claim 21 wherein inducing and regulating a curved propagation comprises the steps of:

allowing a second control cord to frictionally engage, at the moving eversion point, with the liner wall and/or a second sleeve located on the left side of the liner; and selectively applying a second tension force to the proximate end of the second control cord to steer the curved propagation to the left.

23. The method according to claim 20 wherein inducing and regulating a curved propagation comprises the steps of:

allowing a first control cord to frictionally engage, at the moving eversion point, with the liner wall and/or a first sleeve located on the left side of the liner; and selectively applying a first tension force to the proximate end of the first control cord to steer the curved propagation to the left.

24. The method according to claim 20 wherein propagating the liner while allowing the liner to evert further comprises the steps of:

containing in an upper sleeve, diametrically opposite the lower sleeve, an air-filled tube along the length of the liner; and floating the liner on the surface of a body of water, with the air-filled tube disposed along the uppermost side of the liner thereby encouraging the liner to remain oriented with the bendable weight disposed along the lowermost side of the liner.

25. The method according to claim 24, further comprising the step of subsequently utilizing the air-filled tube as a pressurized hose to conduct a fluid to a location at an end of the fully everted liner.

26. The method of claim 24 further comprising, after floating the liner on the surface of a body of water, the steps of:

filling the liner with water;

causing the liner with the air filled tube and the weighted sleeve to sink to the bottom of the body of water body; and driving the liner along the bottom of the water body with the liner oriented with the air-filled tube along the top of the liner.

* * * * *